US006758406B2

(12) United States Patent
Weaver

(10) Patent No.: US 6,758,406 B2
(45) Date of Patent: Jul. 6, 2004

(54) RAIL SWITCH BRACE

(75) Inventor: Brian F. Weaver, Burlington, KY (US)

(73) Assignee: Progress Rail Services Corp., Albertsville, AL (US)

( * ) Notice: Subject to any disclaimer, the term of this patent is extended or adjusted under 35 U.S.C. 154(b) by 0 days.

(21) Appl. No.: 10/252,456

(22) Filed: Sep. 23, 2002

(65) Prior Publication Data

US 2004/0056109 A1 Mar. 25, 2004

(51) Int. Cl.[7] ..... E01B 9/60
(52) U.S. Cl. ..... 238/315; 238/310; 238/292
(58) Field of Search ..... 238/315, 292, 238/347, 310, 321, 336, 349, 323, 333, 331, 351, 359, 361, 264, 287

(56) References Cited

U.S. PATENT DOCUMENTS 1,872,848 A * 8/1932 Told ..... 238/336
2,557,494 A * 6/1951 Asselin ..... 238/292
2,904,256 A * 9/1959 Devaney ..... 238/292
4,566,630 A 1/1986 Keiper, Jr.
4,770,342 A 9/1988 Farrell et al.
4,824,015 A 4/1989 Farrell et al.
4,981,264 A 1/1991 Orasche et al.
5,094,387 A * 3/1992 Rice et al. ..... 238/23
5,104,041 A 4/1992 Remington
6,308,897 B1 10/2001 Remington et al.
6,517,008 B1 * 2/2003 Remington et al. ..... 238/315

OTHER PUBLICATIONS

Schwihag, *Rail Anchoring Systems for Switches*, 4 pages.

* cited by examiner

*Primary Examiner*—Frantz F. Jules
(74) *Attorney, Agent, or Firm*—Bracewell & Patterson, L.L.P.

(57) ABSTRACT

A brace assembly provides support to a railroad rail, such as for a switch. The rail is supported on a tie plate. A wedge block is secured to the tie plate adjacent the rail. A groove is located in the inner wall of the wedge block. The groove extends longitudinally between the side walls and is spaced between the upper and lower sides of the wedge block. A brace has a tapered upper edge and a tapered lower edge that engage the rail. The brace has a tongue that extends outward from the base into the groove. The tongue and groove have widths that decrease from one side to the other. Moving the brace longitudinally relative to the wedge block enables the brace to be wedged between the wedge block and the rail. A spring clip secures the brace to the wedge block.

19 Claims, 4 Drawing Sheets

59a
59c
59
61
59b 63a
65
63c
63
67
63b

RAIL SWITCH BRACE

BACKGROUND OF THE INVENTION

1. Field of the Invention

This invention relates in general to railroad tracks, and in particular to a brace for supporting a rail of a switch assembly.

2. Description of the Prior Art

Braces are needed for rails for certain railroad installations. For example, a switch that enables a rail car to turn from one track onto another track requires a brace because of high lateral and rolling forces that will be exerted by the rail car. These forces tend to push the rail laterally and roll the rail about its axis.

Braces are employed to stabilize the rail. Generally, a brace is mounted to a tie plate and engages one side of a rail. Typically, the contact of the brace is at two points, these being a lower side of the head and an upper side of the base. Some braces are mounted by bolts, which are subject to loosening. Other braces use a spring clip to retain the brace in place. Some of these also have tapered wedging surfaces to wedge the brace between a block on the tie plate and the rail. While workable, improvements are desired.

SUMMARY OF THE INVENTION

The brace assembly of this invention includes a tie plate that has an upper surface portion that receives the base of the rail. A wedge block is secured to the tie plate next to the upper surface portion. The wedge block has an inner wall that faces the web of the rail. A longitudinally extending groove is formed in the inner wall of the wedge block. The brace has an upper edge that engages a downward facing surface of the head of the rail and a lower edge that engages an upward facing surface of the base of the rail.

The brace also has a tongue on the outer side that extends laterally into the groove. The brace and the wedge block have mating tapered surfaces that are at an acute angle relative to the vertical plane through the longitudinal axis of the rail. Moving the brace longitudinally relative to the wedge block allows the brace to be wedged between the wedge block and the rail. A fastener mounted to the wedge block fastens the brace to the wedge block in the desired wedged position.

DETAILED DESCRIPTION OF THE INVENTION

Figure 1:
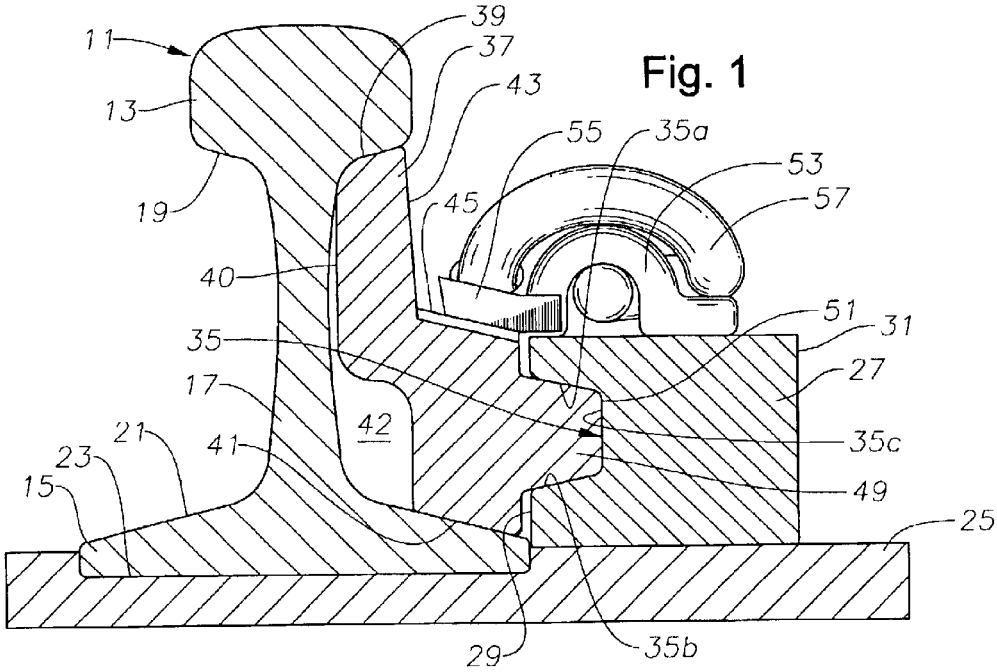
FIG. 1 is a sectional view illustrating a brace assembly constructed in accordance with this invention.
Figure 2:
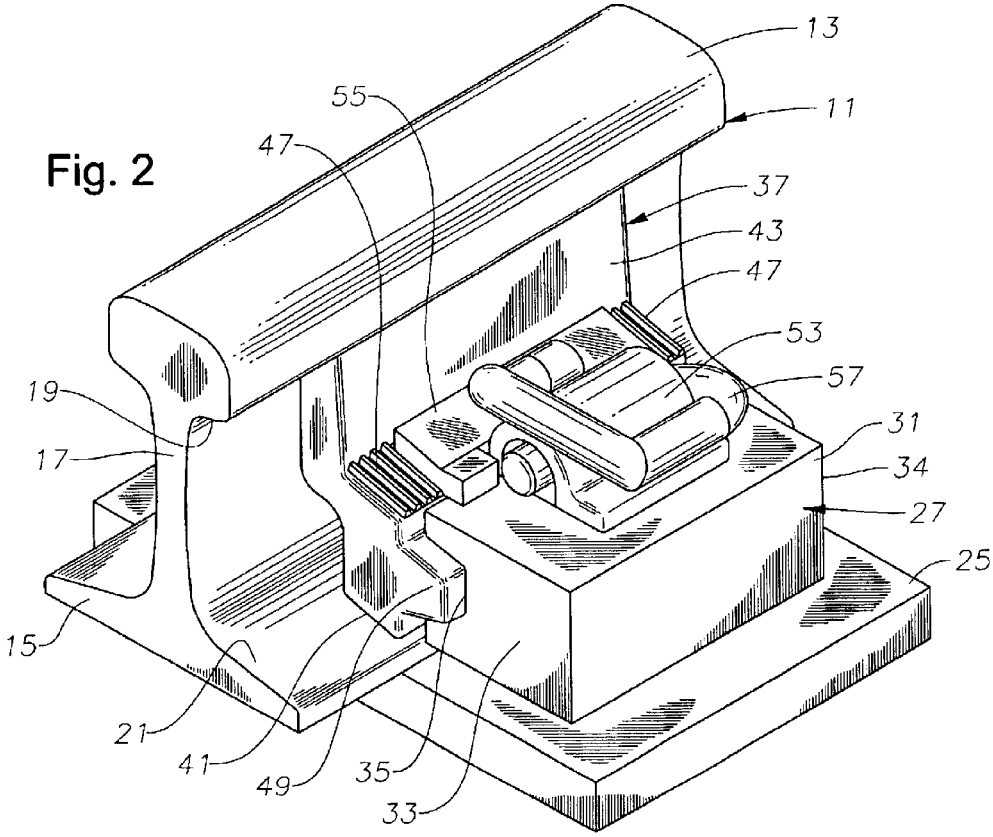
FIG. 2 is a perspective view of the brace assembly of FIG. 1.

Referring to FIG. 1, the rail 11 is a conventional rail having a head 13 and a base 15 connected by a web 17. Head

13 has downward facing inclined surfaces 19 on each side of web 17. Downward facing surfaces 19 taper upwardly from web 17. Similarly, base 15 has upward facing surfaces 21 on each side of web 17. Upward facing surfaces 21 taper downward from web 17.

Rail 11 mounts on a tie plate 25, which in turn is mounted to supporting structure of the switch assembly (not shown). In this embodiment, tie plate 25 has a rectangular recess 23 that closely receives base 15. Recess 23 has a centerline that is parallel with the longitudinal axis of rail 11.

A wedge block 27 is mounted to the upper surface of tie plate 25 alongside recess 23. Wedge block 27 is preferably welded to tie plate 25, but it could be secured by other means or formed integrally with tie plate 25. Wedge block 27 is a rectangular member having an inner wall 29 and an outer wall 31. Inner and outer walls 29, 31 are preferably parallel to each other and to a vertical plane that extends through the longitudinal axis of rail 11. Wedge block 27 also has two side walls 33, 34 that are perpendicular to inner wall 29 and outer wall 31.

A groove 35 is formed in inner wall 29. Groove 35 extends longitudinally from side wall 33 to side wall 34. In the first embodiment, groove 35 has an upper surface **35*a* that tapers downward from inner wall 29. It has a lower surface 35*b* that tapers upward from inner wall 29, thus upper and lower surfaces 35*a*, 35*b* converge toward each other. Lower surface 35*b* is located above the bottom of wedge block 27. Upper and lower surfaces 35*a* and 35*b* are joined by a base surface 35*c*. Base surface 35*c* is flat in this embodiment and faces web 17. A centerline extending equidistant between upper and lower surfaces 35*a*, 35*b* is approximately half way between the top and bottom of wedge block 27** in this embodiment and is located in a horizontal plane.

Figure 3:
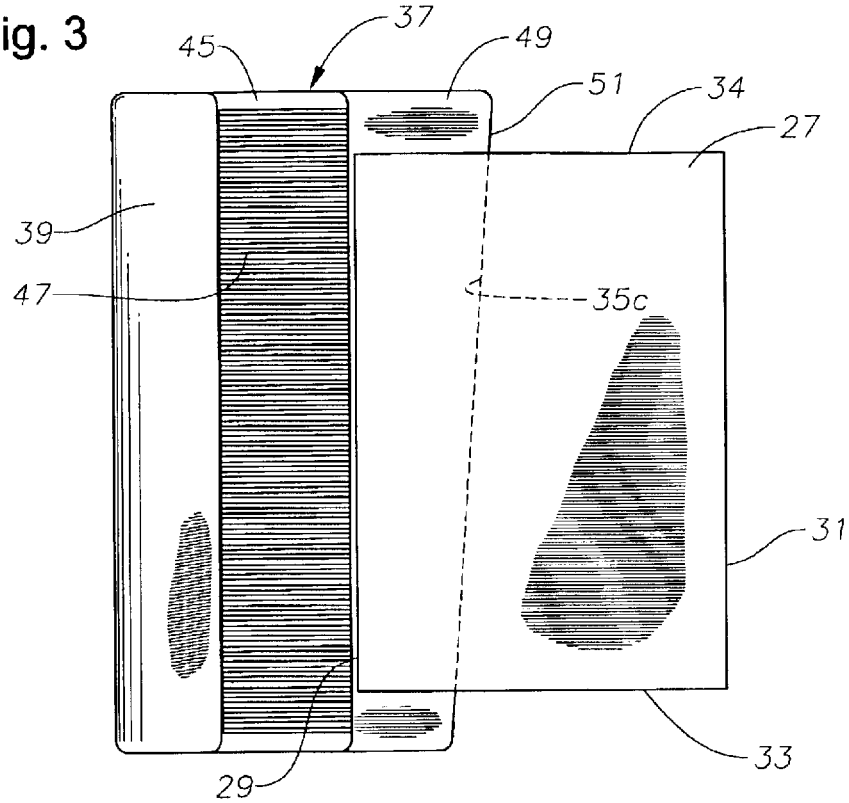
FIG. 3 is a top view of a portion of the brace assembly of FIG. 1, with the rail and the spring clip not being shown.

Groove 35 has a horizontal depth from inner wall 29 to base surface **35*c* that increases from side 33 to side 34. The increase is linear, as indicated by FIG. 3. Base surface 35*c* is thus at an acute angle relative to the longitudinal axis of rail 11. Base surface 35*c* is closer to rail 11 on side 34 than on side 33**.

A brace 37 locates between wedge block 27 and rail 11. Brace 37 has an upper portion with an upper edge 39 that abuts downward facing surface 19 of rail head 13. Upper edge 39 is tapered at the same degree of taper as downward facing surface 19. Brace 37 also has a lower portion with a lower edge 41 that mates with rail base upward facing surface 21. The lower portion and lower edge 41 are spaced farther outward from web 17 than the upper portion and upper edge 39. The lateral width of lower edge 41 is less than the width of base upward facing surface 21, resulting in a lower clearance 42 between the lower half of brace 37 and web 17. An inner wall 40 of the upper portion of brace 37 is spaced close to but not touching web 17. Lower clearance 42 is much larger in lateral width than the small clearance between web 17 and inner wall 40 of the upper portion of brace 37.

The upper portion of brace 37 has an outer wall 43 that is generally parallel with inner wall 40. Outer wall 43 extends downward at a slight angle relative to a vertical plane and joins an upward facing shoulder 45. Shoulder 45 extends laterally outward and also inclines downward at approximately the same as the taper of base lower edge 41. Friction-enhancing elements are located on shoulder 45. In the preferred embodiment, the friction-enhancing elements comprise splines 47, which are parallel straight grooves that extend laterally.

Figure 4:
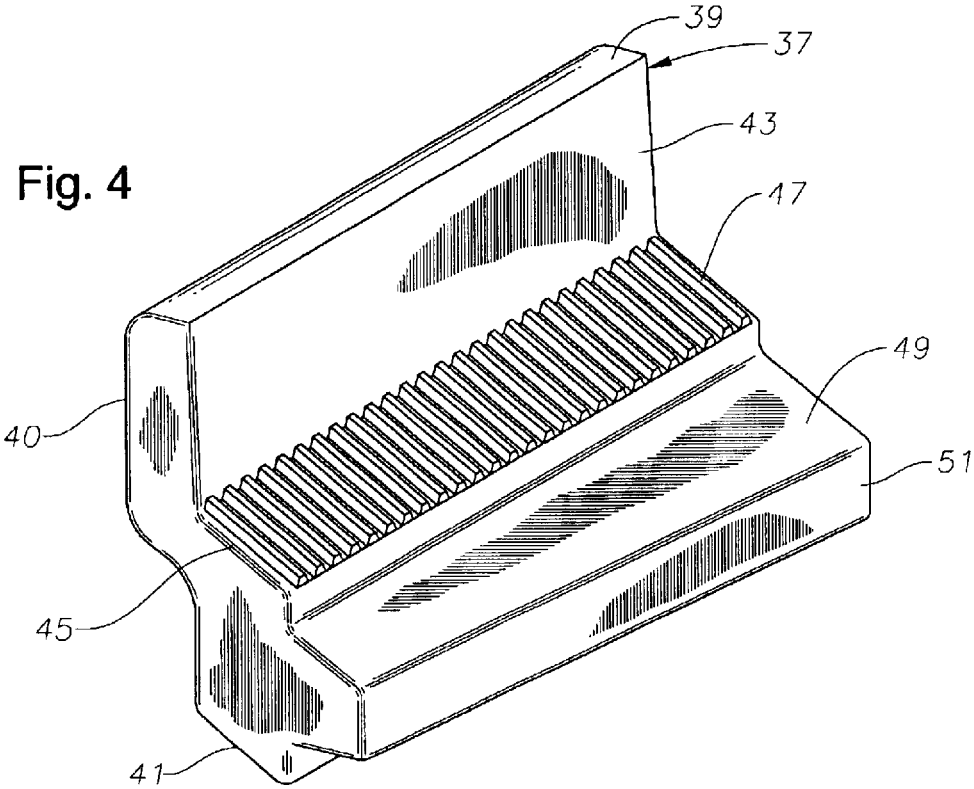
FIG. 4 is a perspective view of the brace of the brace assembly of FIG. 1.

A tongue 49 protrudes outward from brace 37 below shoulder 45 and above lower edge 41. Tongue 49 has the same configuration as groove 35 in the first embodiment to fit closely within groove 35. A plane passing equidistant between the upper and lower surfaces of tongue 49 is horizontal. As shown in FIG. 4, tongue 49 has a greater lateral width at one side than the opposite side. This results in an outer edge 51 that is located at an acute angle relative to a vertical plane passing through the longitudinal axis of rail 11. FIG. 3 shows a top view of brace 37 and wedge block 27, illustrating the engagement of tapered surfaces 35*c* and 51. Moving brace 37 longitudinally in the direction of wedge sidewall 33 will cause brace 37 to move closer to web 17 (FIG. 1). Similarly, moving brace 37 in the opposite longitudinal direction, toward side 34, will cause brace 37 to move farther away from web 17. This allows a worker to wedge brace 37 between wedge block 27 and rail 17 by moving brace 37 longitudinally until upper edge 39 wedges tightly against head downward facing surface 19. Tongue 49 extends longitudinally from one side of brace 37 to the other side of brace 37. The longitudinal dimension of brace 37 is shown to be greater than the longitudinal dimension of wedge block 27 from side 33 to side 34, however, this is not critical.

Referring again to FIG. 1, a fastener is employed to secure brace 37 in the desired wedged position. Preferably the fastener comprises a clip retainer 53 that is secured to the upper side of block 31, such as by welding. A fastener plate 55 is adapted to engage splines 47 of shoulder 45. Fastener plate 55 preferably has mating splines on its lower side. A spring clip 57 has one leg that engages fastener plate 55 and another leg that inserts into clip retainer 53. Clip 57 creates a downward force on fastener plate 55 to hold brace 37 in position.

To install brace 37, rail 11 is placed in recess 23 of tie plate 25. Wedge 37 is inserted between wedge block 27 and rail 11, and tongue 49 is inserted into groove 35. Wedge 37 is moved longitudinally until upper edge 39 wedges against head surface 19. Fastener plate 55 is placed on shoulder 45, and clip 57 is driven into engagement with fastener plate 55 and clip retainer 53. Once installed as shown in FIG. 1, rotating forces tending to rotate rail 11 about its axis and lateral forces tending to push rail 11 laterally are resisted by the brace assembly. The rotating forces are transmitted from head 13 through brace 37 and tongue 49 into wedge block 27. Lateral forces are transmitted from brace 37 through tongue 49 against groove base surface 35*c* and into wedge block 27. The lower portion of the outer wall of brace 37 is spaced from inner wall 29 of block 27, thus directing all of the forces through tongue 49 and into wedge block 27.

Figure 5:
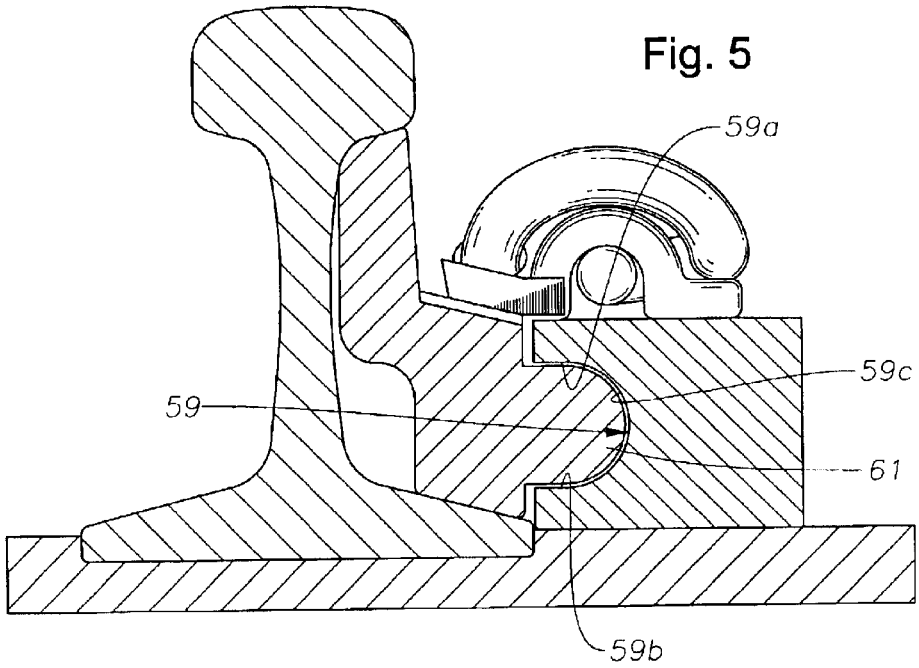
FIG. 5 is a sectional view of a first alternate embodiment of a brace assembly in accordance with this invention.

FIG. 5 shows an alternate embodiment. The components that are the same are not discussed or numbered. The difference is in the configuration of groove 59 as opposed to groove 35 of FIG. 1. Groove 59 has an arcuate configuration rather than flat surfaces. Base surface 59*c* comprises a semi-cylindrical surface. Upper surface 59*a* joins base surface 59*c* and has an entry portion that is a straight surface defined by a line tangent to the semi-cylindrical base surface 59*c*. Similarly, lower surface 59*b* has an entry portion that is straight and parallel to the entry portion of upper surface 59*a*. The entry portions of upper and lower surfaces 59*a*, 59*b* are in horizontal planes. Tongue 61 has the same configuration as groove 59. The brace assembly of FIG. 5 operates in the same manner as that of FIGS. 1–4.

Figure 6:
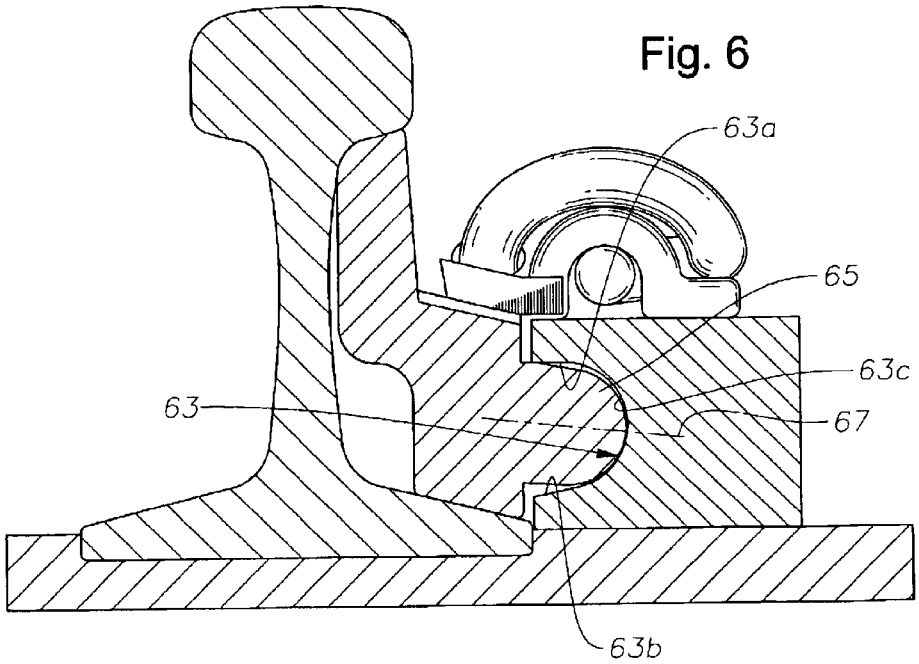
FIG. 6 is a sectional view of a second alternate embodiment of a brace assembly in accordance with this invention.

In FIG. 6, groove 63 is also arcuate, rather than having flat sides as in FIG. 1. In this embodiment, upper surface 63*a* and base surface 63*c* are the same as surfaces 59*a* and 59*c* of FIG. 5. The entry portion of lower surface 63*b*, however tapers downward, rather than being in a horizontal plane as the entry portions of upper surface 63*a*. This facilitates entry of tongue 65, which differs from tongue 61 of FIG. 5. Tongue 65 is also a rounded or arcuate member. However, it has a centerline 67 that is in an inclined plane, rather than horizontal as in FIG. 5.

Figure 7:
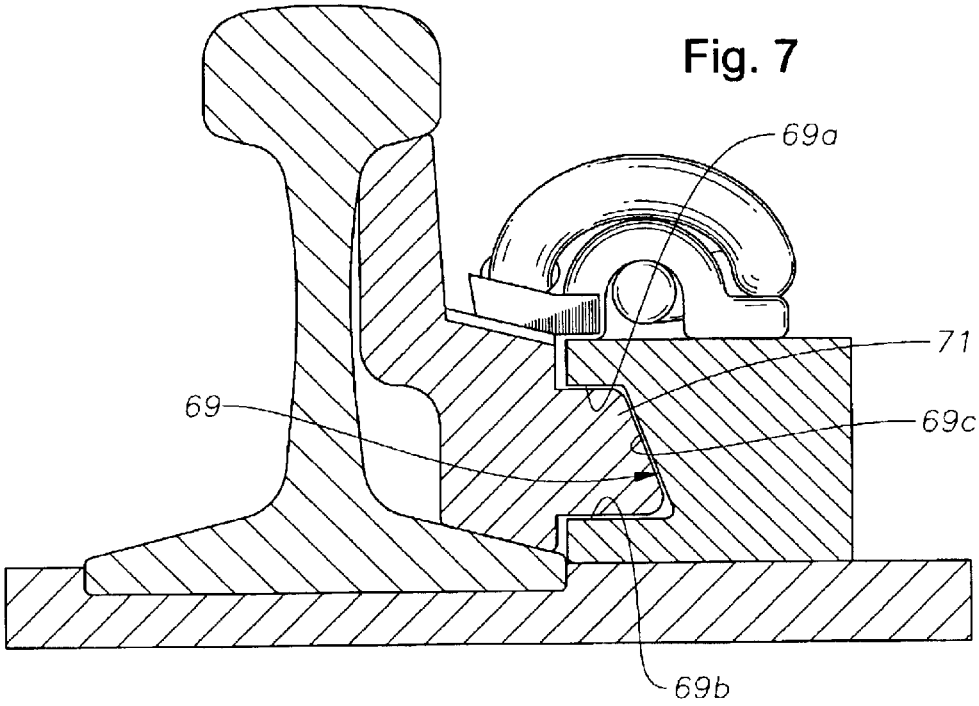
FIG. 7 is a sectional view of a third alternate embodiment of a brace assembly in accordance with this invention.

In FIG. 7, groove 69 is generally of a trapezoidal configuration. It has upper and lower surfaces 69*a* and 69*b* that are flat, parallel and in horizontal planes. However, unlike surface 35*c* of FIG. 1, base surface 69*c* is not in a vertical plane, rather it inclines downward relative to the vertical axis. This results in groove upper surface 69*a* being of a smaller depth than lower surface 69*b*. Tongue 71 has the same configuration as groove 69.

Figure 8:
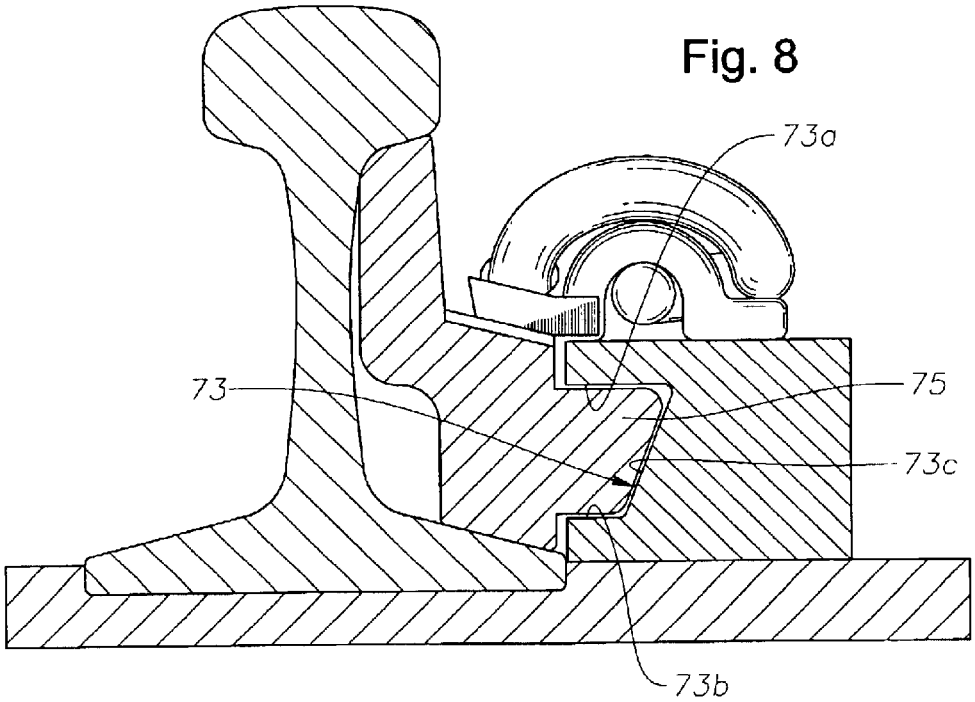
FIG. 8 is a sectional view of a fourth alternate embodiment of a brace assembly in accordance with this invention.

The embodiment of FIG. 8 is similar to the FIG. 7 embodiment but inverted. Groove 73 is trapezoidal in configuration, but its upper surface 73*a* has a greater depth than its lower surface 73*b*. This results in a base 73*c* that is inclined upward relative to a vertical plane. Tongue 75 has the same configuration as groove 73.

The invention has significant advantages. The brace provides strong support against rolling and lateral movement due to the tongue and groove engagement. The wedging surfaces allow the brace to be tightly positioned against the rail.

While the invention has been shown in only a few of its forms, it should be apparent to those skilled in the art that it is no so limited but is susceptible to various changes without departing from the scope of the invention.

I claim:

1. A brace assembly for a rail having a head and a base connected by a web, comprising:

a tie plate having an upper surface portion with a longitudinal centerline for receiving the base of the rail;

a wedge block stationarily mounted on the tie plate adjacent the upper surface portion, the wedge block having an inner wall adapted to face the web of the rail;

a longitudinally extending groove formed in the inner wall of the wedge block;

a brace having an inner side that is adapted to engage the rail and a tongue on an outer side that extends laterally into the groove, the brace, including the tongue, comprising a single, rigid member;

a mating tapered wedge surface on the brace and a mating tapered wedge surface on the wedge block that are at an acute angle relative to the longitudinal centerline, the brace being longitudinally movable relative to the tie plate and the wedge block to wedge the brace wedged against the rail;

a fastener mounted to the wedge block for fastening the brace to the wedge block in a wedged position; and wherein:

the groove has a base portion that is adapted to face toward the web;

the wedge surface on the wedge block is located on the base portion; and the wedge surface on the brace is located on an outer edge of the tongue.

2. The brace assembly according to claim 1 wherein the fastener is a spring clip which is attached to the wedge block and has an outer portion outward of the tongue and an inner portion engaging the brace inward of the tongue.

3. A brace assembly for a rail having a head and a base connected by a web, comprising:

a tie plate having an upper surface portion with a longitudinal centerline for receiving the base of the rail;

a wedge block stationarily mounted on the tie plate adjacent the upper surface portion, the wedge block having an inner wall adapted to face the web of the rail;

a longitudinally extending groove formed in the inner wall of the wedge block;

a brace having an inner side that is adapted to engage the rail and a tongue on an outer side that extends laterally into the groove, the brace, including the tongue, comprising a single, rigid member;

a mating tapered wedge surface on the brace and a mating tapered wedge surface on the wedge block that are at an acute angle relative to the longitudinal centerline, the brace being longitudinally movable relative to the tie plate and the wedge block to wedge the brace wedged against the rail;

a fastener mounted to the wedge block for fastening the brace to the wedge block in a wedged position; and wherein the fastener comprises:

a fastener plate that contacts the brace above the tongue; and a spring clip that has one end secured to a top of the wedge block and another end contacting an upper side of the fastener plate to maintain the fastener plate in tight contact with the brace.

4. The brace assembly according to claim 3, wherein the mating tapered wedge surface on the wedge block is contained within the groove, and the mating tapered wedge surface on the brace is located on the tongue.

5. A brace assembly for a rail having a head and a base connected by a web, comprising;

a tie plate having an upper surface portion with a longitudinal centerline for receiving the base of the rail;

a wedge block stationarily mounted on the tie plate adjacent the upper surface portion, the wedge block having an inner wall adapted to face the web of the rail;

a longitudinally extending groove formed in the inner wall of the wedge block;

a brace having an inner side that is adapted to engage the rail and a tongue on an outer side that extends laterally into the groove, the brace, including the tongue, comprising a single, rigid member;

a mating tapered wedge surface on the brace and a mating tapered wedge surface on the wedge block that are at an acute angle relative to the longitudinal centerline, the brace being longitudinally movable relative to the tie plate and the wedge block to wedge the brace wedged against the rail;

a fastener mounted to the wedge block for fastening the brace to the wedge block in a wedged position; and wherein:

the groove has upper and lower surfaces joined by a base surface; and the tongue has upper and lower surfaces that mate with the upper and lower surfaces respectively, of the tongue.

6. The brace assembly according to claim 5, wherein the upper and lower surfaces of the recess are substantially flat and converge toward each other in a direction toward the base surface.

7. The brace assembly according to claim 5, wherein the upper and lower surfaces of the groove are substantially flat and located in horizontal planes, and the base surface is flat and inclined relative to a vertical plane.

8. A brace assembly for a rail having a head and a base connected by a web, comprising:

a tie plate having an upper surface portion with a longitudinal centerline for receiving the base of the rail;

a wedge block welded to the tie plate adjacent the upper surface portion, the wedge block having an inner wall adapted to face the web of the rail;

a longitudinally extending groove formed in the inner wall of the wedge block;

a brace having an inner side that is adapted to engage the rail and a tongue integrally formed on an outer side of the brace and extending laterally into the groove;

a mating tapered wedge surface on the brace and a mating tapered wedge surface on the wedge block that are at an acute angle relative to the longitudinal centerline, the brace being longitudinally movable relative to tie plate and the wedge block so that moving the brace longitudinally relative to the wedge block enables the brace to be wedged against the rail; and a fastener mounted to the wedge block for fastening the brace to the wedge block in a wedged position;

wherein, the groove has upper and lower surfaces joined by a base surface;

the tongue has upper and lower surfaces that mate with the upper and lower surfaces, respectively, of the groove; and wherein the upper, lower, and base surfaces of the groove define an arcuate configuration.

9. A brace assembly for a rail having a head and a base connected by a web, comprising:

a tie plate having an upper surface portion with a longitudinal centerline for receiving the base of the rail;

a wedge block stationarily mounted on the tie plate adjacent the upper surface portion, the wedge block having an inner wall adapted to face the web of the rail;

a longitudinally extending groove formed in the inner wall of the wedge block;

a brace having an inner side that is adapted to engage the rail and a tongue on an outer side that extends laterally into the groove, the brace, including the tongue, comprising a single, rigid member;

a mating tapered wedge surface on the brace and a mating tapered wedge surface on the wedge block that are at an acute angle relative to the longitudinal centerline, the brace being longitudinally movable relative to the tie plate and the wedge block to wedge the brace wedged against the rail;

a fastener mounted to the wedge block for fastening the brace to the wedge block in a wedged position; and wherein the tongue inclines downward relative to horizontal.

10. A brace assembly for engaging a rail having a longitudinal axis, a head and a base joined by a web, the base having upward facing inclined surfaces, the brace assembly comprising:

a tie plate having an upper surface for supporting the base of the rail;

a wedge block mounted stationarily in contact with the upper surface of the tie plate, the wedge block having an inner wall adapted to face inward toward the web of the rail, the wedge block having oppositely facing side walls longitudinally spaced apart from each other;

a groove located in the inner wall of the wedge block and extending longitudinally between the side walls, the groove having a depth that decreases from one of the side walls to the other of the side walls;

a brace having a tapered lower edge for engaging one of the upward facing inclined surfaces of the base of the rail and an inner side for engaging the rail above the base of the rail;

a tongue extending outward from the brace into the groove, the brace and the tongue being a unitary member, the tongue having a width that decreases from one side of the tongue to another side of the tongue to mate with the groove, the brace being longitudinally movable relative to the tie plate and the wedge block to reach a wedged position against the rail;

an upward facing shoulder on the brace inward from the tongue;

a fastener plate that mates with the upward facing shoulder; and a spring clip having one end secured to an upper side of the wedge block and another end applying a downward force on the fastener plate to retain the brace in the wedged position.

11. The brace assembly according to claim 10, wherein the upward facing shoulder on the brace has a friction-enhancing surface.

12. The brace assembly according to claim 10, further comprising a plurality of splines on the upward facing shoulder of the brace.

13. The brace assembly according to claim 10, wherein the tongue is located at a lower elevation than the upward facing shoulder.

14. The brace assembly according to claim 10 wherein:

the groove has upper and lower surfaces joined by a base surface; and the tongue has upper and lower surfaces that mate with the upper and lower surfaces, respectively, of the tongue.

15. The brace assembly according to claim 10, wherein the upper and lower surfaces of the groove are substantially flat and converge toward each other in a direction toward the base surface.

16. The brace assembly according to claim 10, wherein the brace has two oppositely facing side walls longitudinally spaced apart from each other, and the tongue extends from one of the side walls to the other of the side walls of the brace.

17. The brace assembly according to claim 10, wherein the spring clip is attached to the wedge block and has an outer portion outward of the tongue and has an inner portion engaging the brace inward of the tongue.

18. A brace assembly for engaging a rail having a longitudinal axis, a head and a base joined by a web, the base having upward facing inclined surfaces, the brace assembly comprising:

a tie plate having an upper surface for supporting the base of the rail;

a wedge block stationarily mounted to the upper surface of the tie plate, the wedge block having an inner wall adapted to face inward toward the web of the rail, the wedge block having oppositely facing side walls longitudinally spaced apart from each other;

a groove located in the inner wall of the wedge block and extending longitudinally between the side walls, the groove having a depth that decreases from one of the side walls to the other of the side walls;

a brace having a tapered lower edge for engaging one of the upward facing inclined surfaces of the base of the rail and an inner side for engaging the rail above the base of the rail;

a tongue extending outward from the brace into the groove, the brace and the tongue being a unitary member, the tongue having a width that decreases from one side of the tongue to another side of the tongue to mate with the groove, the brace being longitudinally movable relative to the tie plate and the wedge block to enable the brace to reach a wedged position against the rail;

an upward facing shoulder on the brace inward and at an elevation higher than the tongue;

a plurality of parallel splines formed on the upward facing shoulder;

a fastener plate that mates with the splines on the upward facing shoulder; and a spring clip having one end secured to an upper side of the wedge block and another end applying a downward force on the fastener plate to retain the brace in the wedged position.

19. A brace assembly for a rail having a head and a base connected by a web, comprising:

a tie plate having an upper surface portion with a longitudinal centerline for receiving the base of the rail;

a wedge block stationarily mounted on the tie plate adjacent the upper surface portion, the wedge block having an inner wall adapted to face the web of the rail;

a longitudinally extending groove formed in the inner wall of the wedge block;

a brace having an inner side that is adapted to engage the rail, a tongue on an outer side that extends laterally into the groove;

a mating tapered wedge surface on the brace and a mating tapered wedge surface on the wedge block that are at an acute angle relative to the longitudinal centerline, the brace being longitudinally movable relative to the tie plate and the wedge block to to enable the brace to be wedged against the rail; and a fastener mounted to the wedge block for fastening the brace to the wedge block in a wedged position, the fastener being attached to the wedge block and having an outer portion outward of the tongue and an inner portion engaging the brace inward of the tongue.

* * * * *